US009731948B2

(12) United States Patent
Brighenti et al.

(10) Patent No.: US 9,731,948 B2
(45) Date of Patent: Aug. 15, 2017

(54) METHOD FOR FEEDING A SUPPLY STATION OF A PACKAGING UNIT WITH A NEW REEL OF SHEET PACKAGING MATERIAL, SHEET PACKAGING MATERIAL HOLDER AND LIFT TRUCK

(71) Applicant: TETRA LAVAL HOLDINGS & FINANCE S.A., Pully (CH)

(72) Inventors: Massimo Brighenti, Carpi (IT); Renzo Bellei, Modena (IT); Andrea Polizzi, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 169 days.

(21) Appl. No.: 14/721,377

(22) Filed: May 26, 2015

(65) Prior Publication Data

US 2015/0251868 A1 Sep. 10, 2015

Related U.S. Application Data

(62) Division of application No. 13/144,388, filed as application No. PCT/EP2010/057624 on Jun. 1, 2010, now Pat. No. 9,073,716.

(30) Foreign Application Priority Data

Jun. 1, 2009 (EP) ..... 09161622

(51) Int. Cl.
*B66F 9/18* (2006.01)
*B65H 57/26* (2006.01)
(Continued)

(52) U.S. Cl.
CPC ..... *B66F 9/18* (2013.01); *B65H 19/102* (2013.01); *B65H 57/26* (2013.01); *B65H 57/18* (2013.01); *B65H 2405/4226* (2013.01)

(58) Field of Classification Search
CPC . B66F 9/183; B66F 9/184; B66F 9/18; B65H 57/14; B65H 57/04; B65H 57/003; B65H 2405/40; B65H 57/18; B65H 57/26
See application file for complete search history.

(56) References Cited

U.S. PATENT DOCUMENTS 2,076,458 A * 4/1937 Hall ..... B21C 47/34 242/566
3,037,651 A 6/1962 Smith
(Continued)

FOREIGN PATENT DOCUMENTS

CN 1225330 A 8/1999
CN 101291849 A 10/2008
(Continued)

OTHER PUBLICATIONS

International Search Report (PCT/ISA/210) mailed on Aug. 17, 2010, by the European Patent Office as the International Searching Authority for International Application No. PCT/EP2010/057624.
(Continued)

*Primary Examiner* — Glenn Myers
(74) *Attorney, Agent, or Firm* — Buchanan Ingersoll & Rooney PC

(57) ABSTRACT

There is described a method for feeding a supply station (6) of a packaging unit (1) with a new reel (3*a*) of sheet packaging material, comprising the steps of releasably connecting a sheet packaging material holder (11) to a support structure (5); coupling an end portion (52) of new reel (3*a*) with holder (11) connected, in turn, to support structure (5); carrying out on end portion (52) at least an operation, which is preliminary for joining of end portion (52) to a first edge (53) of a terminated reel (3*a'*, 3*b*) previously connected to packaging unit (1); moving new reel (3) together with holder (11) from support structure (5) towards supply station (6);
(Continued)

and releasably connecting a fixed part (12) of supply station (6) to holder (11) together with new reel (3*a*).

6 Claims, 8 Drawing Sheets

(51) Int. Cl.
*B65H 19/10* (2006.01)
*B65H 57/18* (2006.01)

(56) References Cited

U.S. PATENT DOCUMENTS

| | | | | |
|---|---|---|---|---|
| 3,050,273 | A * | 8/1962 | Saunders | B62B 1/264 242/557 |
| 3,452,511 | A | 7/1969 | Hoffler | |
| 3,795,370 | A * | 3/1974 | Dean | G03D 13/145 242/536 |
| 4,279,567 | A | 7/1981 | Thompson | |
| 5,330,126 | A | 7/1994 | Grischenko | |
| 5,362,191 | A | 11/1994 | Beckmann | |
| 5,584,446 | A | 12/1996 | Delmore et al. | |
| 6,142,408 | A | 11/2000 | Focke et al. | |
| 6,767,318 | B2 | 7/2004 | Spatafora et al. | |
| 8,833,523 | B2 * | 9/2014 | Simpson | B66F 9/08 182/141 |
| 9,272,656 | B2 * | 3/2016 | Molen | B60P 7/0876 |
| 2009/0184192 | A1 | 7/2009 | Takatsuka et al. | |
| 2009/0229229 | A1 | 9/2009 | Tsuruta et al. | |
| 2010/0024364 | A1 | 2/2010 | Schagidow et al. | |

FOREIGN PATENT DOCUMENTS

| | | | | |
|---|---|---|---|---|
| DE | 19700570 | A1 | 7/1998 | |
| EP | 0203046 | A2 * | 11/1986 | B65H 57/006 |
| EP | 0610590 | A | 8/1994 | |
| EP | 0847947 | A | 6/1998 | |
| EP | 1132330 | A | 9/2001 | |
| GB | 2073717 | A | 10/1981 | |
| JP | 57-181747 | U | 11/1982 | |
| JP | 59220214 | A * | 12/1984 | |
| JP | 4-153152 | A | 5/1992 | |
| JP | 2000264507 | A * | 9/2000 | |
| JP | 2006-143351 | A | 6/2006 | |
| RU | 2071927 | C1 | 1/1997 | |
| SU | 889583 | | 12/1981 | |
| WO | WO 2008/017450 | A1 | 2/2008 | |

OTHER PUBLICATIONS

Written Opinion (PCT/ISA/237) mailed on Aug. 17, 2010, by the European Patent Office as the International Searching Authority for International Application No. PCT/EP2010/057624.

English language version of First Office Action and Search Report dated Dec. 17, 2013, issued by the Chinese Patent Office in the corresponding Chinese Patent Application No. 201080024895.2 (10 pages).

Office Action issued on Mar. 25, 2014, by the Japanese Patent Office in corresponding Japanese Patent Application No. 2012-513597, and an English translation of the Office Action, (6 pages).

Office Action (Decision on Grant) issued on May 20, 2014, by the Russian Patent Office in corresponding Russian Patent Application No. 2011152608, and an English translation of the office action. (14 pages).

Office Action issued on Jun. 12, 2015, by the Japanese Patent Office in corresponding Japanese Patent Application No. 2014-165465 and an English translation of the Office Action. (6 pages).

* cited by examiner

METHOD FOR FEEDING A SUPPLY STATION OF A PACKAGING UNIT WITH A NEW REEL OF SHEET PACKAGING MATERIAL, SHEET PACKAGING MATERIAL HOLDER AND LIFT TRUCK

This application is a divisional of U.S. patent application Ser. No. 13/144,388, filed on Jul. 13, 2011, which is a U.S. National Stage application based on International Patent Application No. PCT/EP2010/057624, filed on Jun. 1, 2010, the entire content of both of which is incorporated herein by reference.

TECHNICAL FIELD

The present invention relates to a method for feeding a supply station of a packaging unit with a new reel of sheet packaging material, to a sheet packaging material holder and to a lift truck.

BACKGROUND ART

Many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may be defined by a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging units having a supply station fed with reels of sheet packaging material.

In greater detail, a pair of reels is mounted on the supply station, and each reel has a hollow core mounted on a spindle.

More precisely, a first reel is processed by the packaging unit while a new second reel is mounted on supply station and remains idle during the operation of the packaging unit.

During the operation of the packaging unit, the packaging material of the first reel slides within a slot defined by a first packaging material holder connected to a fixed part of the supply station.

In particular, a continuous tube is formed from the web-fed packaging material in the packaging unit; the web of packaging material is sterilized in the packaging unit, e.g. by applying a chemical sterilizing agent such as a hydrogen peroxide solution, which is subsequently removed, e.g. by heating and evaporation, from the surfaces of the packaging material.

The sterilized web is maintained in a closed, sterile environment, and is folded into a cylinder and sealed longitudinally to form a tube.

The tube is fed in a first vertical direction parallel to its axis, is filled continuously with the sterilized or sterile-processed food product and is heat-sealed at equally spaced cross sections by two pairs of jaws to form pillow packs each having a top and a bottom transverse sealing band, i.e. a band extending along a second direction orthogonal to the first direction. Pillow packs are separated by cutting respective sealing bands and are then fed to a folding station, in which they are fold so as to form respective packages.

When the packaging material of the first reel is almost totally unwound from the core and almost all of the packaging material has passed through the slot of the first packaging material holder, a head movable within the supply station cuts the packaging material immediately downstream from the first packaging material holder. In this way, a first edge of the packaging material of the terminated first reel overhangs from the first packaging material holder while a second edge of the packaging material of the terminated first reel remains within the supply station of the packaging unit. In particular, first and second edge are parallel and spaced one another.

As packaging unit processes first reel, an operator inserts an end portion of the new second reel within the slot of a second packaging material holder, so that such end portion overhangs from such second packaging material holder.

Furthermore, the operator carries out a plurality of operations preliminary for the joining of the end portion of the new second reel to the second edge of the packaging material of the terminated first reel.

More precisely, the operator arranges, at the supply station, the end portion of the new second reel in the correct position with respect to the second packaging material holder and cuts the end portion along a slanted line. In this way, the operator forms a third edge of the new second reel; such third edge is positioned and shaped so as to perfectly match the second edge of the first reel.

At the end of these preliminary operations, third edge of the second reel overhangs from second packaging material holder connected to a fixed part of the supply station.

After having cut packaging material of first reel, head welds the second edge of the first reel to the third edge of the new second reel, so that the operation of packaging unit may continue processing the packaging material of the new second reel.

In a second time, the operator removes the core of the terminated first reel together with the packaging material extending between the core and the first edge, and feeds the supply station with a further new reel of packaging material.

A need is felt within the industry to meet the tolerance requirements for the joining of the second edge of terminated first reel to the third edge of new second reel while reducing, or even eliminating, the presence of operators at the supply station of the packaging unit.

DISCLOSURE OF INVENTION

It is an object of the present invention to provide a method for feeding a supply station of a packaging unit with a new reel of packaging material, a packaging material holder and a lift truck, designed to meet the above requirement in a straightforward, low-cost manner.

According to the present invention, there is provided a method for feeding a supply station of a packaging unit with a new reel of sheet packaging material, as claimed in claim 1.

According to the present invention, there is provided a sheet packaging material holder, as claimed in claim 6.

Finally, according to the present invention, there is provided a lift truck as claimed in claim 12.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 2:
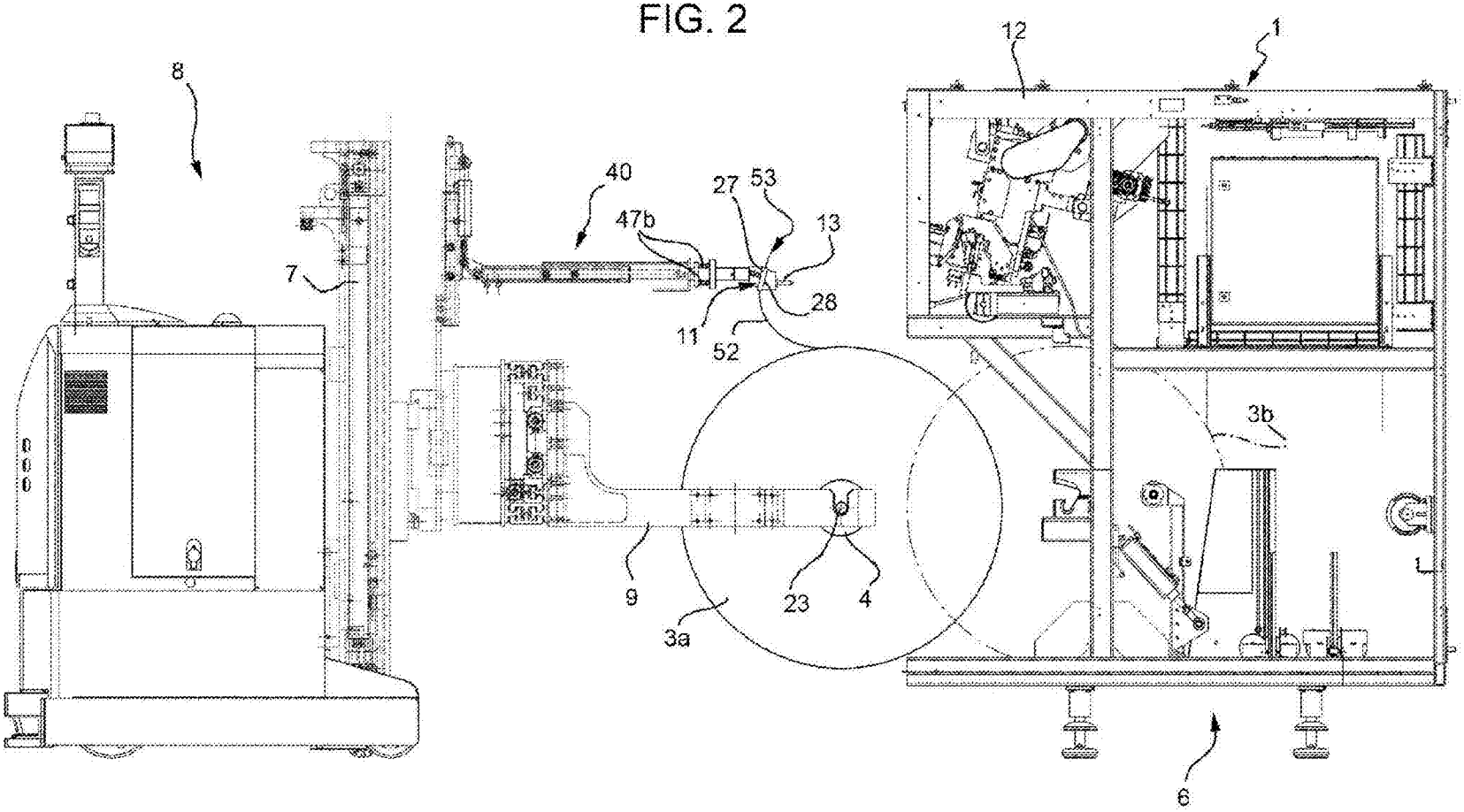

Number 1 in FIG. 2 indicates as a whole a packaging unit for producing sealed packages of food product from a tube of sheet packaging material by processing a reel 3*b* of packaging material.

Figure 1:
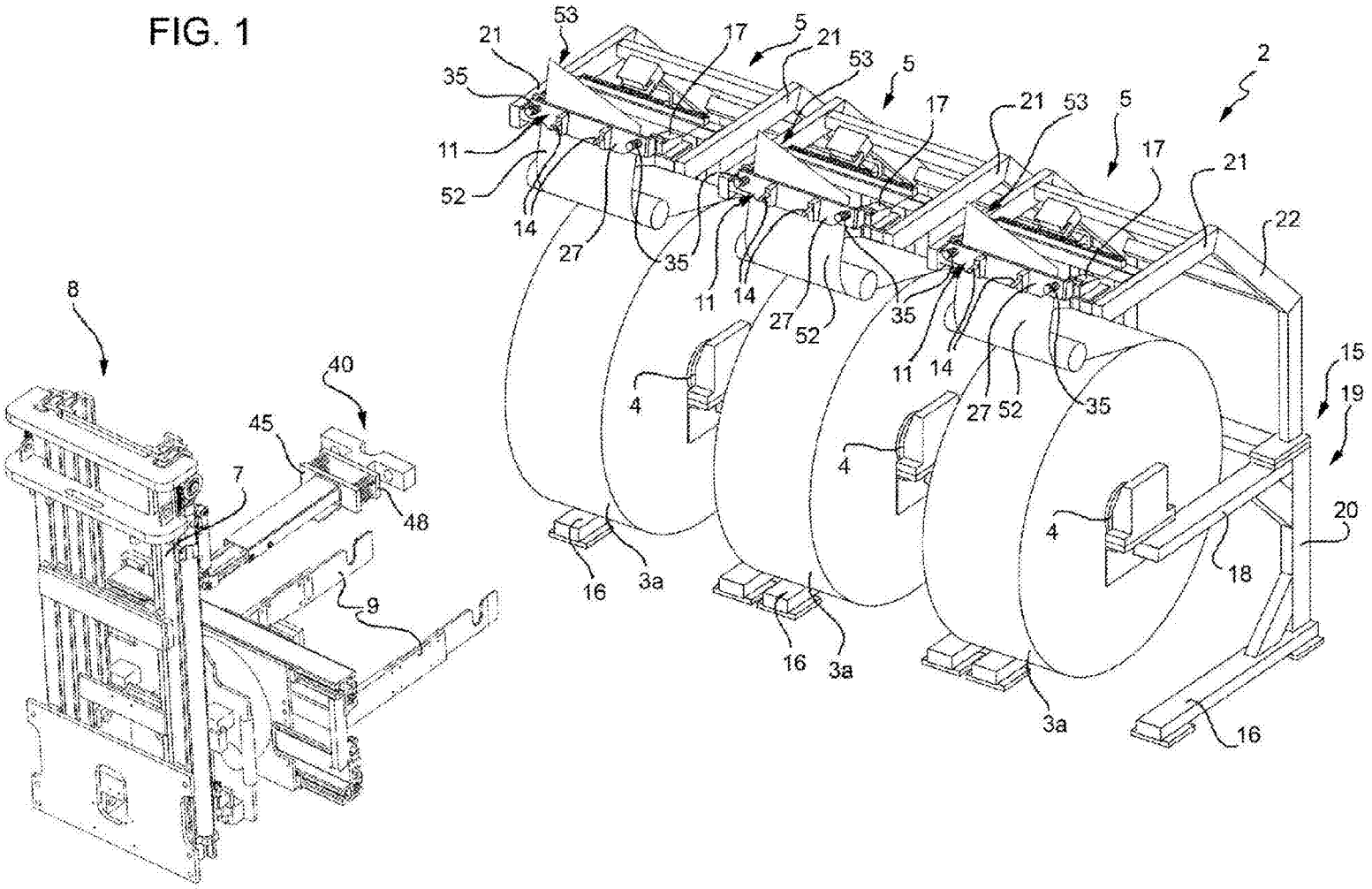
FIGS. 1 and 2 show in perspective and lateral view respective subsequent steps of a method for feeding a supply station of a packaging unit with a new reel of packaging material, according to the present invention.
Figure 3:
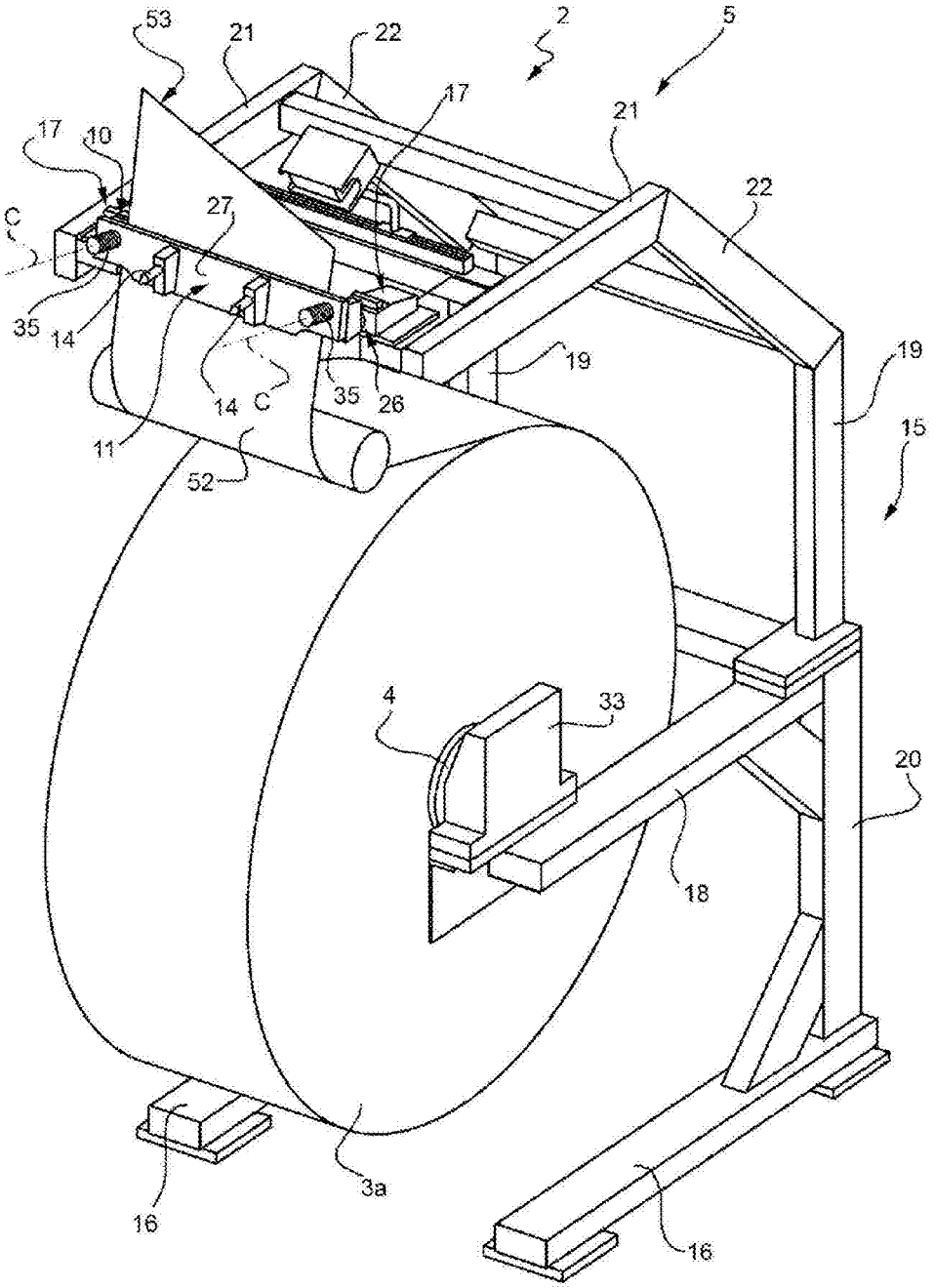
FIG. 3 is an enlarged perspective view of a stand of FIG. 1, with parts removed for clarity.

A plurality of packaging units 1 (only one of which is shown in FIG. 2) are part of a packaging plant shown in FIGS. 1 to 3 with limitation to a storage station 2 of a plurality of new reels 3*a* of packaging material (FIGS. 1 and 3) and to a plurality of lift trucks 8 movable between storage station 2 and a supply station 6 of packaging unit 1.

Figure 8:
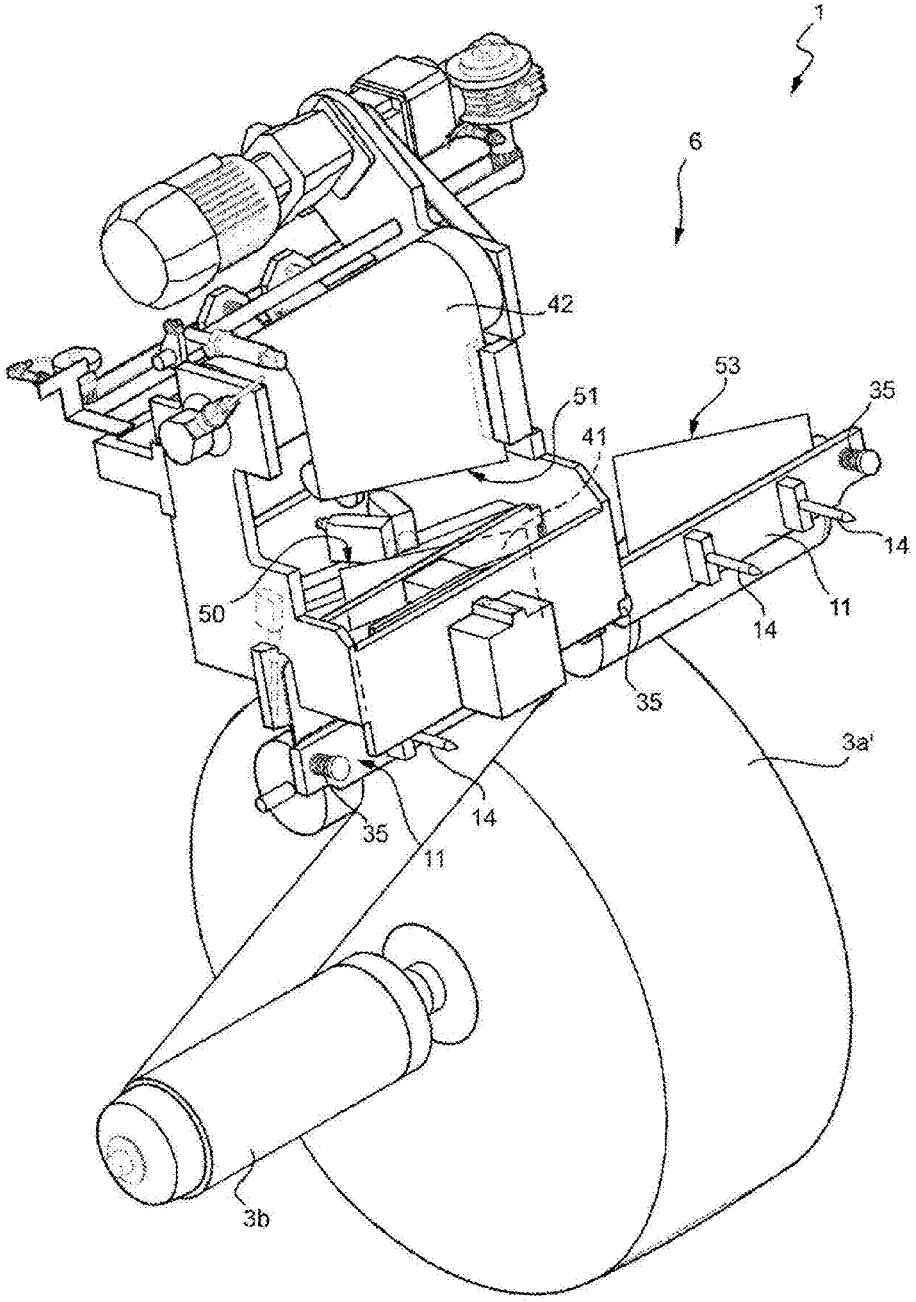
FIG. 8 shows in a perspective view a supply station of packaging unit of 1.

In greater detail, new reel 3*a*' and reel 3*b* are mounted on the supply station 6. Reel 3*b* is processed by packaging unit 1 in order to form packages while new reel 3*a*' remains idle during the operation of the packaging unit 1 (FIG. 8). Once reel 3*b* has terminated, the packaging material of new reel 3*a*' is joined to the packaging material of terminated reel 3*b*, terminated reel 3*b* is unloaded from supply station 6 and one new reel 3*a* is loaded onto supply station 6.

Very briefly, each reel 3*a*, 3*a*', 3*b* comprises a hollow core 4 onto which a sheet of packaging material is wound. Furthermore, a spindle 23 is inserted within core 4.

Storage station 2 comprises a plurality of stands 5 supporting respective new reels 3*a* with which supply station 6 of packaging unit 1 is fed.

Each lift truck 8 substantially comprises a frame 7 and a pair gripping arms 9 movable with respect to one another for gripping or releasing a respective new reel 3*a*. Furthermore gripping arms 9 of each lift truck 8 may rotate integrally one another about a horizontal direction and may slide integrally one another along a vertical direction.

Furthermore, lift trucks 8 may be automatically guided within packaging plant. In particular, lift trucks 8 may be laser-guided.

Packaging unit 1 preferably produces sealed packages of a pourable food product, such as pasteurized or UHT milk, fruit juice, wine, etc.

Packaging unit 1 may also produce sealed packages of a food product which is pourable into tube when producing packages, and sets after packages are sealed. One example of such a food product is a portion of cheese, which is melted when producing packages, and sets after packages are sealed.

The packaging material has a multilayer structure (not shown) and comprises a layer of fibrous material, normally paper, covered on both sides with respective layers of heat-seal plastic material, e.g. polyethylene. In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of package eventually contacting the food product.

Tube is formed in known manner by longitudinally folding and sealing a web (not shown) of heat-seal sheet material, is filled by a fill pipe (not shown) with the sterilized or sterile-processed food product for packaging, and is fed, in known manner not shown, along a vertical path, is heat-sealed and cut at equally spaced cross sections.

Supply station 6 substantially comprises (FIGS. 2, 4, 6, 7 and 8) a frame 12 and supporting means (not shown) for rotatably supporting spindles 23 of new reel 3*a*' and reel 3*b* with respect to frame 12.

During operation of packaging unit 1, sheet packaging material of processed reel 3*b* passes through a slot 10 of a relative packaging material holder 11 fitted to frame 12 of supply station 6.

Differently, only an end portion 52 of sheet packaging material of new reel 3*a*' passes through a slot 10 of a further packaging material holder 11 fitted to frame 12 of supply station 6.

Furthermore, supply station 6 comprises a head (not-shown) movable within frame 12. Such head cuts the end portion of each reel 3*b* adjacent to core 4 when such reel 3*b* is almost totally terminated.

With reference to FIG. 8, head cuts the sheet packaging material adjacent to core 4 immediately downstream from holder 11 and along a slanted line with respect to the feeding direction of sheet packaging material.

In this way, the end portion adjacent to core 4 of each terminated reel 3*b* is divided by head in a first part 41 still wound onto core 4 and overhanging from holder 11 and in a second part 42 supported by packaging unit 1.

With reference to FIG. 8 (left side), the head forms an end edge 50 on first part 41 of terminated reel 3*b* an end edge 51 on second part 42 of terminated reel 3*b*. More precisely, edges 50, 51 are parallel, face one another, and are spaced.

Subsequently, a new reel 3*a* is joined to edge 51.

As it will be clear from the rest of the present description, an operator carries out on new reel 3*a*' (3*a*) a plurality of operations preliminary for the joining of new reel 3*a*' (3*a*) to edge 51 of terminated reel 3*b* (3*a*').

In particular, the operator forms, by cutting, an edge 53 (FIG. 5) in end portion 52 of new reel 3*a*' (3*a*) opposite to relative core 4. Such edge 53 is slanted and matches the conformation of edge 51 of terminated reel 3*b* (3*a*').

Once reel 3*b* (3*a*') has terminated, head welds the edge 51 of terminated reel 3*b* (3*a*') with edge 53 of new reel 3*a*' (3*a*).

With reference to FIGS. 1 and 3, each stand 5 comprises a frame 15, a pair of supporting element 33 for supporting spindle 23 of stored reel 3*a*, and a pair of connecting elements 17 supported by frame 15.

More precisely, frame 15 substantially comprises:

two horizontal base elements 16;

two horizontal elements 18 arranged parallel and above elements 16; and two uprights 19 having each a vertical portion 20 extending from respective base element 16, a horizontal portion 21 arranged parallel and supporting a relative connecting element 17 and a slanted portion 22 extending between respective portions 20, 21.

Supporting elements 33 (only one of which shown) have trapezoidal cross-section and are supported by respective elements 18 of frame 15.

Connecting elements 17 are supported by portions 21 of respective uprights 19.

Advantageously, holder 11 comprises a pair of pins 13 which may be releasably connected to either respective seats 25 (FIGS. 6 and 7, left side) defined by frame 12 of supply station 6 or to seats 26 (FIGS. 3 and 5) defined by respective connecting elements 17 of stand 5, and a pair of pins 14 which may be releasably connected to holes 43 of a connecting structure 40 (FIGS. 4 and 5) connected to frame 7 of lift truck 8.

Due to the fact that holders 11 may be releasably connected both to frame 12 and to stand 5, preliminary operations are carried out on new reels 3*a* at stands 6 and, afterwards, new reels 3*a* are moved towards supply station 6.

Holder 11 further comprises two parallel plates 27, 28 defining slot 10 therebetween, a pair of prismatic elements 29 protruding from a first side, opposite to plate 28, of plate 27 and supporting pins 14, and a pair of prismatic elements 30 protruding from a second side, opposite to first side, of plate 27 and supporting pins 13.

More precisely, pins 13, 14 have a cylindrical main portion 31 extending respectively from elements 30, 29 and a tapered end portion 32.

Main portion 31 of each pin 13 comprises an annular groove 24 adapted to cooperate with spherical end of a relative dowel (not shown) housed within relative seat 25, 26. More precisely, dowel extends orthogonally to relative seat 25, 26 and is elastically loaded towards a position, in which it keeps relative pin 13 within relative seat 25, 26.

Figure 4:
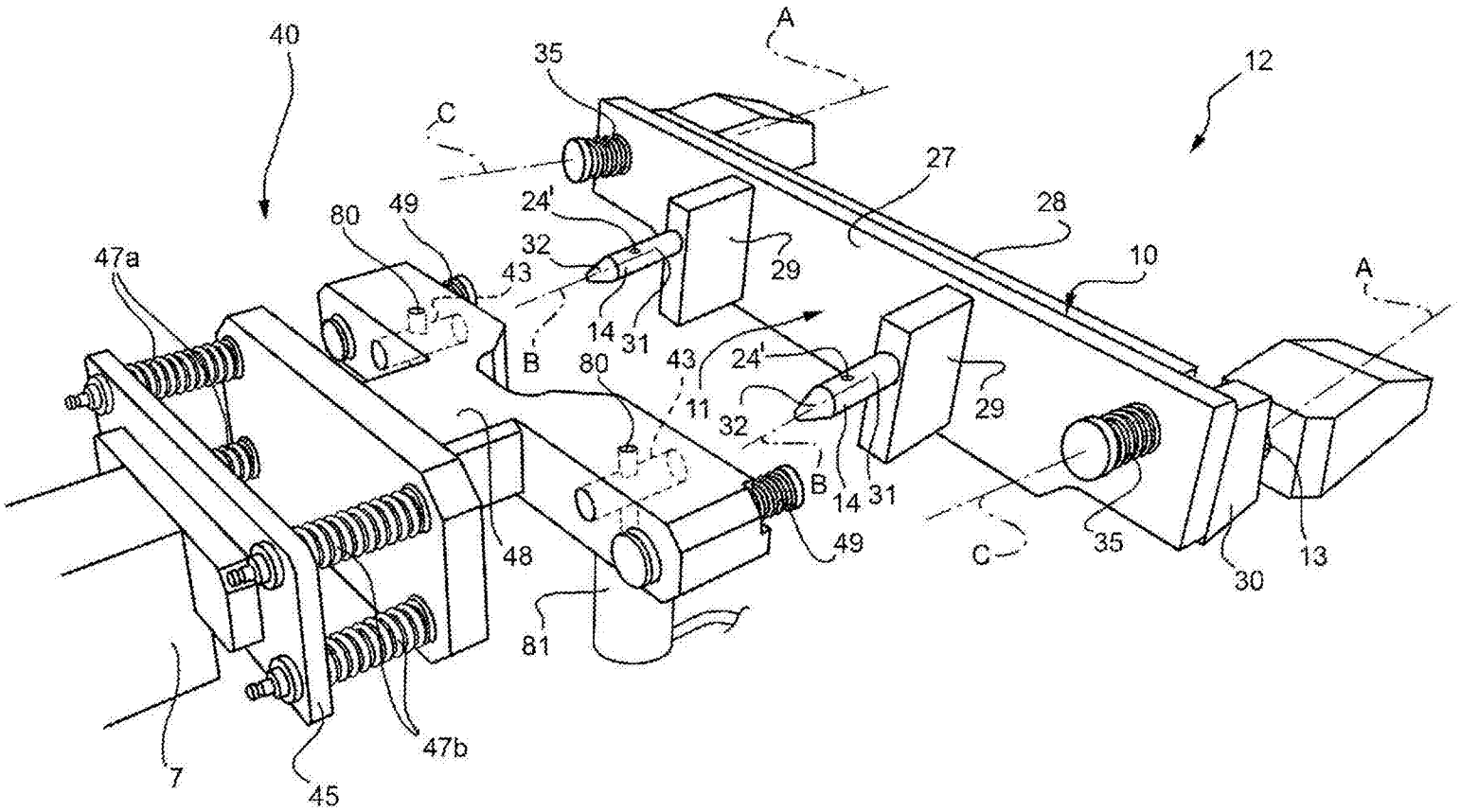
FIGS. 4 and 5 show in perspective view a packaging material holder according to the present invention in two different operative configurations.

Furthermore, each pin 14 comprises a through hole 24' extending orthogonally to the axis of relative pin 14 and connecting structure 40 comprises further holes 80 orthogonal and passing through holes 43 (FIG. 4).

When pins 14 engage holes 43, dowels moved by an actuator 81 (FIG. 5) engages further holes 80 and connect connecting structure 40 to holder 11.

Pins 13, 14 extend along respective axes A, B parallel to one another. More precisely, axes B are interposed between axes A.

Furthermore, holder 11 comprises a pair of springs 35 wound on respective pins, partially interposed between plates 27, 28, and loading plate 28 against plate 27.

In particular, springs 35 are helical and extend along respective axes C sloped with respect to axes A, B.

More precisely, each axis C is interposed between a relative axis A and corresponding axis B. Furthermore, axes C are orthogonal to plates 27, 28.

Figure 6:
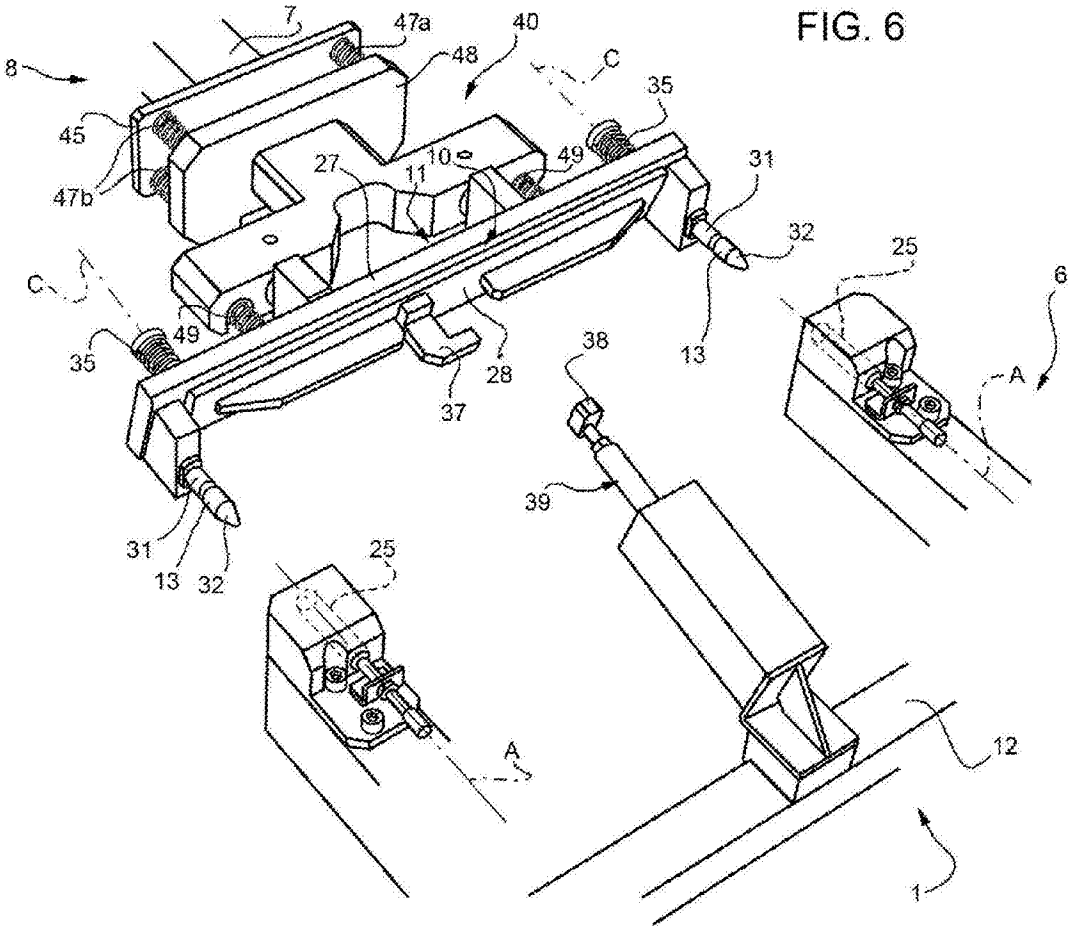
FIG. 6 shows a packaging material holder from a different visual angle with respect to FIGS. 4 and 5, a portion of lift truck according to the present invention, and a supply station of packaging unit of FIG. 2, with parts removed for clarity.
Figure 7:
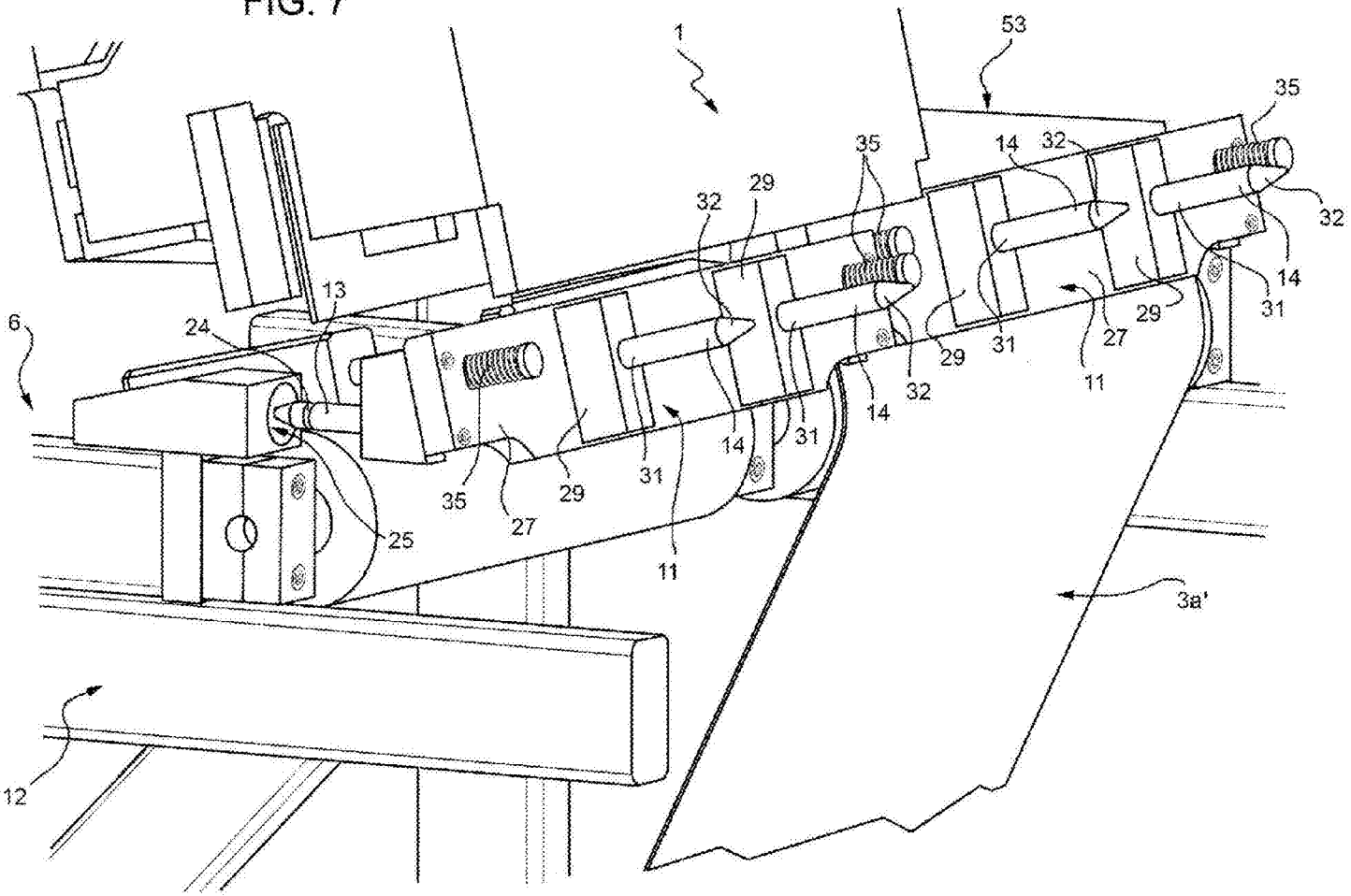
FIG. 7 shows in a perspective enlarged view a pair of packaging material holders of FIGS. 4 to 6 coupled with the packaging unit of FIG. 1, with parts removed for clarity.

Plate 28 comprises, on the face opposite to slot 10, a toothed appendix 37 (FIG. 6).

Supply station 6 comprises a variable-length actuator 39 having, in turn, an end 38 (FIG. 6) which engages appendix 37 to move away plate 28 from plate 27, so allowing sheet packaging material to pass through slot 10 during operation of packaging unit 1.

Figure 5:
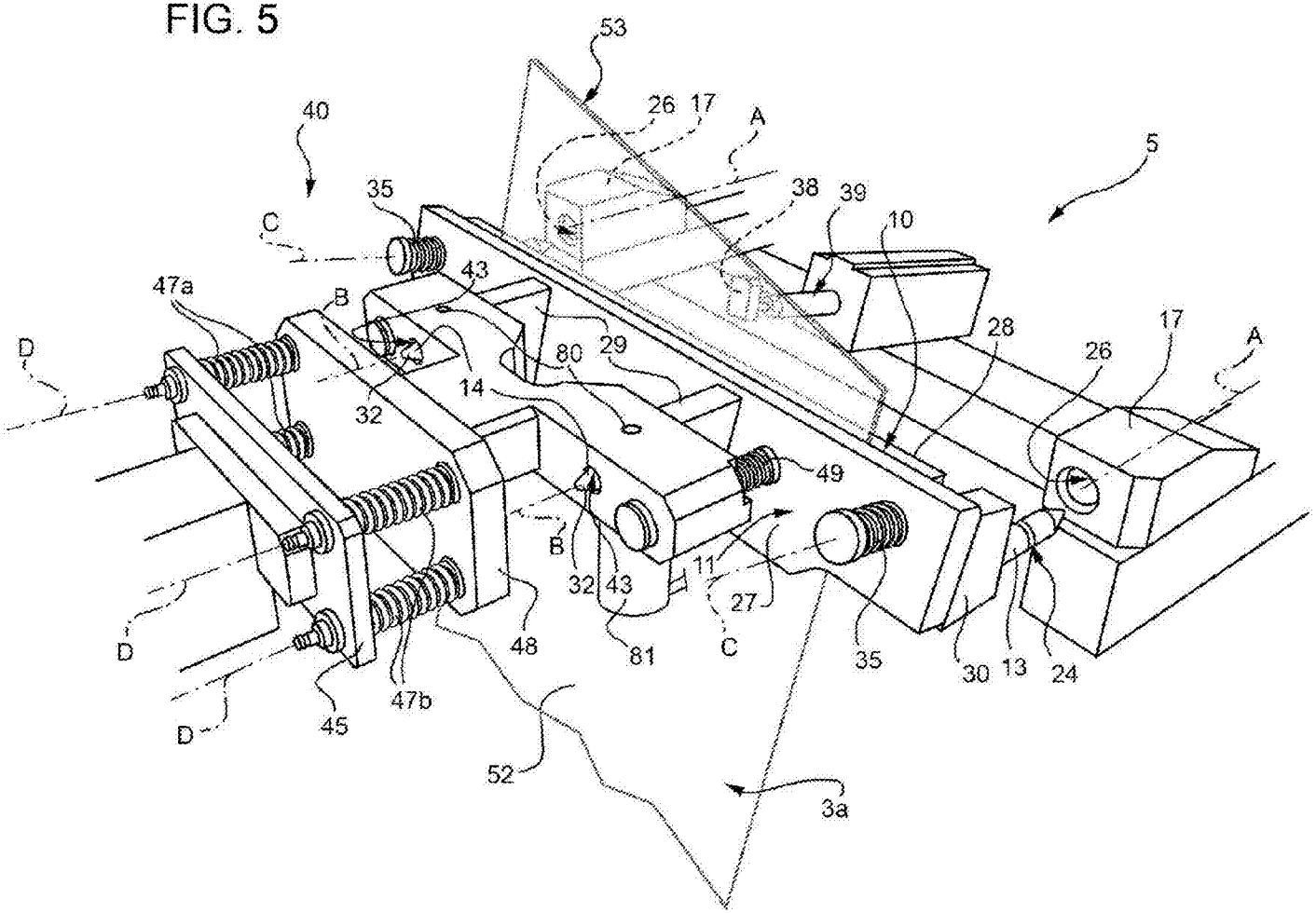

In a completely analogous manner, each stand 5 comprises a variable length actuator 39 adapted to move away plate 28 from plate 27, so allowing the operator to arrange end portion 52 of reel 3*a* within slot 10 and with respect to holder 11 (FIG. 5).

Connecting structure 40 comprises a plate 45 connected to an arm protruding from frame 7 of lift truck 8, a body 48 and a plurality of springs 47*a*, 47*b* interposed between plate 45 and body 48.

In particular, the arm may be moved with respect to frame 7 along three directions orthogonal to each other. Two directions lie on the plane of FIG. 2 while a third direction is orthogonal to the plane of FIG. 2.

More precisely, body 48 extends on the opposite side of plate 45 with respect to frame 7 and defines a pair of through holes 43 (FIG. 5) engaged by pins 14 when holder 11 is connected to lift truck 8.

Springs 47*a*, 47*b* are in the embodiment depicted in the number of four and extend along respective axes D (FIG. 5).

Two springs 47*a* have respective axes D on the same first vertical plane and other springs 47*b* have respective axes D on the same second vertical plane.

Each spring 47*a* is parallel to a relative spring 47*b*.

Axes D are parallel to axis A, B.

Finally, connecting structure 40 comprises a pair of springs 49 projecting from body 48 on the opposite side of plate 45 and having a free end opposite to body 48.

When pins 13 of holder 11 are connected to seats 25 of frame 12 and pins 14 are connected to connecting structure 40, springs 49 abut against plate 27 (FIG. 5) and thrust plate 27 against plate 28. In this way, holder 11 remains connected, by pins 13 inserted within seats 25, to frame 12 when lift truck 8 moves away from supply station 6.

In use, new reels 3*a* are supported on relative stands 5 at storage station 2 and holders 11 are connected in a releasable way to relative stands 5 (FIG. 1).

At the same time, reel 3*b* is processed by packaging unit 1 while new reel 3*a*' remains idle at the supply station 6.

When reel 3*b* processed by packaging unit 1 is almost totally terminated, the head of packaging unit 1 cuts the portion of sheet packaging material of reel 3*b* adjacent to core 4 downstream from holder 11 previously connected to frame 12 of supply station 6. In this way, head of packaging unit 1 forms part 41 with edge 50 which overhangs from holder 11. Furthermore, head forms part 42 with edge 51 which is supported by packaging unit 1 downstream from holder 11 (FIG. 8).

At this stage, head welds edge 51 of terminated reel 3*b* with edge 53 of new reel 3*a*' already fitted to supply station 6.

With reference to holders 11 connected to stands 5, pins 13 are inserted within relative seats 26 of connecting elements 17 of a relative stand 5. In particular, grooves 24 are engaged by spherical end of dowels, so releasably fastening pins 13 within seats 26.

Furthermore, spindles 23 are inserted within cores 4 of respective new reels 3*a* and are supported by relative supporting elements 33.

For the sake of simplicity, the operation of holder 11 and lift truck 8 is hereinafter described with reference to only one holder 11, only one new reel 3*a* and only one stand 5.

In particular, actuator 39 of stand 5 moves away appendix 37, and therefore plate 28, from plate 27 against the elastic action of springs 35.

In this way, the operator may easily insert sheet packaging material of new reel 3*a* within slot 10, up to it overhangs from holder 11.

The operator carries out a plurality of operations on end portion 52 of new reel 3*a*. These operations are preliminary for subsequent joining of end portion 52 of new reel 3*a* to edge 51 of a terminated reel 3*a*' (3*b*) processed by packaging unit 1.

More precisely, operator checks out the quality of the sheet packaging material, cuts end portion 52 along a slanted line with respect to direction along which sheet packaging material extends. In this way, the operator forms edge 53. Furthermore, the operator arranges the position of sheet packaging material of new reel 3*a* with respect to pins 13 in such a given position that edge 53 will perfectly match edge 51 of terminated reel 3*a*' (3*b*) (FIG. 3).

Once the operator has carried out the preliminary operations on the sheet packaging material of new reel 3*a*, actuator 39 of stand 5 approaches appendix 37 and, therefore, plate 28 to plate 27. In this way, sheet packaging material of new reel 3*a* is firmly gripped within slot 10 of holder 11.

In a second time, lift truck 8 detaches holder 11 with terminated reel 3*b* and relative core 4 from supply station 6.

More precisely, lift truck 8 approaches supply station 6 up to holes 43 are engaged by pins 14 and moves away from supply station 6, so detaching holder 11 with terminated reel 3*b* from supply station 6.

Lift truck 8, when moving away from supply station 6, detaches pins 13 from seats 25 of such supply station 6.

In order to feed the packaging unit 1 with new reel 3*a*, a further (or the same) lift truck 8 removes holder 11 together with new reel 3*a* with edge 53 from stand 5, moves holder 11 together with new reel 3*a* from stand 5 to supply station 6 of packaging unit 1, and finally connects holder 11 to frame 12 of supply station 6 and spindle 23 of new reel 3*a* to supporting means of supply station 6.

In greater detail, lift truck 8 approaches holder 11 releasably connected to stand 5 up to springs 49 abut against plate 27, and pins 14 of holder 11 engages holes 43 of connecting structure 40.

In particular, actuator 81 move dowels inside further holes 80, so connecting connecting structure 40 to holder 11.

Afterwards, lift truck 8 moves away from stand 5 with the connecting structure 40 releasably connected to holder 11.

When lift truck 8 moves holder 11 together with new reel 3*a* from stand 5 to supply station 6, springs 47*a*, 47*b* ensure that accidental vibrations do not affect the correct position of edge 53 with respect to holder 11. Furthermore, spindle 23 of new reel 3*a* is supported by gripping arms 9.

Lift truck 8 with holder 11 and new reel 3*a* approaches supply station 6 and insert pins 13 of holder 11 within seats 25 of frame 12, so as to releasably connect holder 11 to frame 12.

In particular, during the movement of lift truck 8 towards supply station 6 and the connection of holder 11 to frame 12, springs 35 load plate 28 towards plate 27, so that sheet packaging material is firmly gripped within slot 10 and edge 53 is prevented from varying its position with respect to holder 11.

After having connected holder 11 to frame 12, lift truck 8 moves away from holder 11, so that pins 14 release holes 43.

More precisely, when lift truck 8 moves away from supply station 6, the action of springs 49 thrusts plate 27 against plate 28. Accordingly, holder 11 remains connected, by pins 13 inserted within seats 25, to frame 12 of supply station 6.

Once holder 11 has been connected to frame 7 and core 4 of new reel 3*a* has been coupled with relative spindle 23, edge 53 overhangs from holder 11 and has a shape that perfectly matches with edge 51 of reel 3*a*'.

Once reel 3*a*' has almost totally terminated, head of packaging unit 1 welds edge 51 of terminated reel 3*a*' with edge 53 of new reel 3*a*. Actuator 39 of supply station 6 moves away plate 28 from plate 27 so allowing sheet packaging material to move through slot 10, and the operation of packaging unit 1 continues processing the packaging material of new reel 3*a*.

The advantages of method of feeding packaging unit 1 with a new reel 3*a*, of holder 11 and of lift truck 8 according to the present invention will be clear from the foregoing description.

In particular, the method of feeding packaging unit 1 with a new reel 3*a*, holder 11 and lift truck 8 according to the present invention allow to correctly arrange edge 53 of new reel 3*a* with respect to edge 51 of terminated reel 3*b* without requiring the presence of operators at supply station 6.

In fact, lift truck 8 may be easily laser controlled, so that operators are necessary only to carry out the preliminary operations at stands 5.

In this way, all the operations of unloading terminated reels 3*b* (3*a*'), detaching new reels 3*a* from stands 5 and loading new reels 3*a* to supply station 6 can be fully automated.

Thanks to the fact they are carried out at stands 5, preliminary operations become completely independent from the operation of packaging unit 1. As a consequence, it is possible to feed a first number (for example ten) of packaging units 1 by using a second number (for example five) of stands 5 lower than first number of packaging units 1.

Thanks to the fact that same pins 13 connect holder 11 either to stand 5 or to supply station 6 of packaging unit 1, the operator may easily arrange sheet packaging material of new reel 3*a* in a correct position with respect to seats 25 of frame 12 by simply arranging such sheet packaging material with respect to pins 14 of holder 11.

Thanks to the fact that springs 35 thrust plate 27, 28 towards one another, sheet packaging material is firmly gripped within slot 10 when is moved by lift truck 8 from stand 5 towards supply station 6 and when holder 11 is connected to frame 12 of supply station 6.

Accordingly, edge 53 of new reel 3*a* remains in the correct position with respect edge 51 of terminated reel 3*b* after that holder 11 has been removed by lift truck 8 from stand 5.

The presence of springs 47*a*, 47*b* ensures that accidental vibrations do not negatively affect on the position of edge 53 of new reel 3*a* with respect to edge 51 of terminated reel 3.

Furthermore, springs 47*a*, 47*b* allow to recover alignments errors between pins 13, 14 and respectively seats 25, 26 and holes 43, so avoiding that pins 13, 14 do not properly engage seats 25, 26 and holes 43.

Clearly, changes may be made to the method of feeding supply station 6 of packaging unit 1 with new reel 3*a*, to sheet packaging material holder 11 and to lift truck 8 without, however, departing from the scope of the present invention as defined in the accompanying claims.

In particular, actuator 39 and end 38 may be replaced respectively by a cam and a follower.

The invention claimed is:

1. A sheet packaging material holder comprising:

a slot, through which sheet packaging material wound onto a reel may slide when said sheet packaging material is disposed through the slot;

first releasably connecting means for connecting said holder either to a fixed part of a supply station of a packaging unit or to a support structure of said reel;

second releasably connecting means for connecting said holder to a lift truck;

a first plate and a second plate defining said slot therebetween;

wherein said first and second releasably connecting means comprise respectively first and second pins; and said first plate supporting said first and second pins on opposite sides of said first plate.

2. The holder according to claim 1, comprising elastic means loading, in use, said first and second plates towards one another in a position in which they firmly grip said sheet packaging material within said slot.

3. The holder according to claim 2, wherein said elastic means load, in use, said first plate against said second plate, and wherein said second plate comprises integrally a first element which is movable away from said first plate.

4. The holder according to claim 1, wherein said first pins extend along respective first axes parallel one another, and said second pins extend along respective second axes parallel one another; said second axes being arranged between said first axes.

5. A lift truck comprising:

a frame;

gripping means supported by said frame and adapted to support a reel of sheet packaging material; and a connecting structure connected to said frame and releasably connectable to a sheet packaging material holder that is configured to be coupled with an end portion of said reel, and wherein said connecting structure comprises:

a plate connected to said frame and possessing opposite first and second sides;

a body comprising a hole which is releasably engageable by a pin of said holder;

elastic means arranged between said body and said first side of said plate; and at least a first spring protruding from said body on said second side of said plate and haying a free end which abuts, in use, against said holder.

6. The lift truck according to claim 5, wherein said elastic means comprise at least a first spring and a second spring; and wherein said first spring, said second spring and said hole extend along respective axes parallel to one another.

* * * * *